United States Patent [19]

Ely et al.

[11] Patent Number: 4,852,486

[45] Date of Patent: Aug. 1, 1989

[54] PORTABLE FLEXOGRAPHIC PROOFER DEVICE

[75] Inventors: James E. Ely; Steven D. Saylor, both of Charlotte, N.C.

[73] Assignee: BASF Corporation, Clifton, N.J.

[21] Appl. No.: 275,874

[22] Filed: Nov. 25, 1988

[51] Int. Cl.[4] ..... B41F 7/02

[52] U.S. Cl. ..... 101/218; 101/247; 101/351; 101/363; 101/145

[58] Field of Search ..... 101/216, 218, 219, 247, 101/348, 363, 137, 139, 140, 143, 144, 145, 182, 184, 194, 351, 352, 362

[56] References Cited

U.S. PATENT DOCUMENTS

| | | | |
|---|---|---|---|
| 1,442,287 | 1/1923 | Mattern | 101/216 |
| 1,979,927 | 11/1934 | Anderson | 101/216 |
| 2,719,483 | 10/1955 | Smith | 101/247 |
| 2,991,713 | 7/1961 | McFarland | 101/348 |
| 3,057,292 | 10/1962 | Larsen | 101/247 |
| 3,092,021 | 6/1963 | Gruver | 101/216 |
| 3,331,318 | 7/1967 | Augustyn et al. | 101/216 |
| 3,361,060 | 1/1968 | Hoexter et al. | 101/216 |
| 3,578,766 | 5/1971 | Diolot | 101/247 |
| 3,780,670 | 12/1973 | Abler et al. | 101/363 |
| 3,894,488 | 7/1975 | Gazzola et al. | 101/247 |
| 3,987,726 | 10/1976 | Corse | 101/247 |
| 4,554,869 | 11/1985 | Ranino, Sr. | 101/145 |

FOREIGN PATENT DOCUMENTS

| | | | |
|---|---|---|---|
| 741105 | 11/1955 | United Kingdom | 101/216 |
| 756013 | 8/1956 | United Kingdom | 242/147 M |

*Primary Examiner*—Eugene H. Eickholt

*Attorney, Agent, or Firm*—Michael R. Chipaloski

[57] ABSTRACT

A portable manually operated flexographic proofer device is provided which comprises a base; a top plane, mounted on the base, on which a printing substrate is received and which has an aperture therein; a cylindrical drive roll, having an elastomer covering on the cylindrical surface thereof, mounted within the base so that a portion of the cylindrical surface thereof is exposed through the aperture in the top plate; a drive motor for the impression roll for providing rotation thereof at a constant speed; and a pivotable applicator unit which carries an aniulox cylinder and a transfer roller. In the operative position of the unit, the transfer roller exerts pressure on the portion of the drive roll exposed through the aperture in the top plate. A weight device of a calibrated weight is mounted on the applicator unit so that the pressure exerted by the transfer roller on the drive roll is substantially constant. A clutch-brake unit is disposed between the drive roll and the drive motor, and a variable speed control unit is provided for the drive motor.

20 Claims, 2 Drawing Sheets

PORTABLE FLEXOGRAPHIC PROOFER DEVICE

FIELD OF THE INVENTION

The present invention relates to flexographic printing and, more particularly, to a portable flexographic proofer device which provides proofs on a repeatable basis.

BACKGROUND OF THE INVENTION

As defined in *Flexography, Principles and Practices,* third edition, flexography "is a method of direct rotary printing using resilient raised image printing plates, affixable to plate cylinders of various repeat lengths, inked by a roll or doctor blade wiped metering roll, carrying fluid or paste type inks to virtually any substrate", although the term has even more broadly been used. The only widely accepted method of duplicating the flexographic printing process on a small scale is through the use of flexographic hand proofers. Although there are several commercial models available, all provide the same basic mode of operation, viz., applying ink to the substrate by manually rolling the hand proofer across the substrate.

Such prior art hand proofers are characterized in operation by two major variables. First, the speed with which the operator rolls the hand proofer varies from operator to operator and even with the same operator. Second, the pressure with which the operator presses the hand proofer onto the substrate varies in the same way. Because of these variables, it is virtually impossible to obtain repeatable proofs, i.e., proofs which are substantial duplicates of each other, even using the same hand proofer and the same ink, particularly if different operators are involved.

Patents relating to printing or embossing devices which are of possible interest with respect to the present invention include: U.S. Pat. Nos. 1,979,927 (Andersen); 2,991,713 (McFarland); 3,361,060 (Hoexter et al); 3,578,766 (Diolot); 3,894,488 (Gazzola); 3,987,726 (Corse); and 4,627,342 (Yui). Briefly considering these references, the Hoexter et al patent discusses flexographic printing and discloses a machine for mounting and proofing rubber printing plates wherein the impression cylinder and the plate cylinder are "locked" into engagement with each other. The Andersen and McFarland patents disclose hand printers, with the latter patent being concerned with a device for inking the roller of a portable proof press. The Corse patent discloses a rotary offset press wherein a spring arrangement creates pressure between blanket and engraved cylinders. The Diolot and Gazzola patents disclose an embossing machine and an intaglio press, respectively, wherein hydraulics are used to control the pressure exerted. The Yui patent discloses a printer including a clutch-brake unit.

SUMMARY OF THE INVENTION

In accordance with the invention, a portable flexographic proofer device is provided which overcomes the two basic disadvantages of prior art hand proofers discussed above, viz., the variation in speed and the variation in pressure encountered with the use of prior art proofers, and thus enables repeatable proofs to be obtained.

Very broadly speaking, the speed variable encountered with prior art devices is eliminated by the use of a constant speed drive motor while the pressure variable is eliminated by the use of calibrated weights in controlling the pressure. In addition, a round impression roller is used so as to enable the reproduction of the same angles of printing encountered with commercial flexographic printing and to permit faster proofing speeds through the provision of a clutch-activated cylinder.

According to a preferred embodiment of the invention, a portable, manually fed flexographic proofer device is provided which comprises: a cylindrical drive roll or roller; a drive motor for the drive roll for providing rotation thereof at a constant speed so as to provide advancement of a substrate through the device; an ink carrying roller or cylinder, also referred to as an anilox roller or cylinder and comparable to the plate roller of a rotogravure printer; an applicator or transfer (printing) roller for transferring ink from the anilox roller to a substrate; and a mounting arrangement for mounting the anilox roller and the transfer roller and movable between an inoperative position thereof and a operative position thereof in which the transfer roller exerts pressure on the drive roll, and thus on a substrate received therebetween, the mounting arrangement including weight receiving means for removably receiving at least one calibrated weight so as to control the pressure exerted by the transfer roller on the drive roll such that a substantially constant pressure is applied to the drive roll and thus to a substrate received between the transfer roller and the drive roll. In addition, a doctor blade is preferably provided which is also mounted on the mounting arrangement so as to engage the anilox roller and to remove excess ink therefrom.

Preferably, the proofer device of the invention further comprises a clutch-brake unit disposed between the drive roll and the drive motor which affords the advantage with respect to proofing speeds as mentioned above, a speed control unit being provided for enabling selection of a desired constant speed.

Advantageously, the device further comprises a base in which the drive roll is mounted, with the mounting arrangement for the transfer and anilox rollers being mounted on the base. Further, a top plate is advantageously mounted on the base which has an aperture therein, and the drive roll is mounted within the base such that a portion of the drive roll is exposed through the aperture so as to permit the transfer roller to exert pressure on the drive roll.

In a preferred embodiment thereof, the drive roll comprises a cylindrical metallic roll having a elastomer covering on the cylindrical surface thereof.

In a preferred embodiment of the mounting arrangement, a mounting cradle is provided and an applicator unit, which carries the transfer and anilox rollers, is mounted on said mounting cradle. Advantageously, the mounting cradle comprises a pair of uprights having aligned notches formed in the edges thereof and the applicator unit includes a mounting rod which is selectively and removably mountable between aligned notches of the pair of uprights.

The applicator unit preferably includes a pair of spaced side walls having aligned slots therein in which the anilox roller is removably received. In one preferred embodiment, a mounting rod for the anilox roller, which is received in the slots of the applicator unit, is adapted so that the opposite ends of the rod extend laterally outwardly of the side walls of the applicator unit on opposite sides thereof, and calibrated weights mounted on the opposite ends of the rod.

In a second preferred embodiment, calibrated weights are removably mounted directly on the applicator unit, preferably by means of bolts and nuts.

In a specific, advantageous embodiment, the top plate comprises a pair of plates each having a slotted edge including a central slot therein, and the plates are mounted on the base with the slotted edges thereof in abutment such that the central slots therein are aligned to form the aforementioned aperture.

Other features and advantages of the invention will be set forth in, or apparent from, the detailed description of preferred embodiments of the invention which follows.

DESCRIPTION OF A PREFERRED EMBODIMENT

Figure 1:
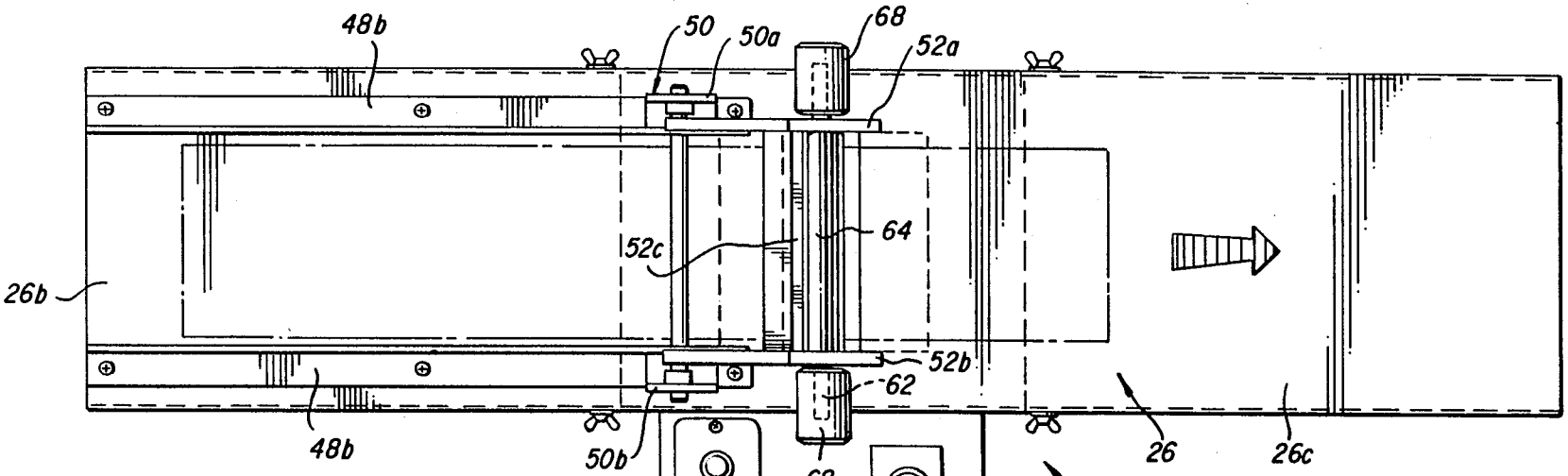
FIG. 1 is a top plan view of the proofer device of the invention illustrating, in broken lines, the travel of a sheet of paper or other substrate therethrough.
Figure 2:
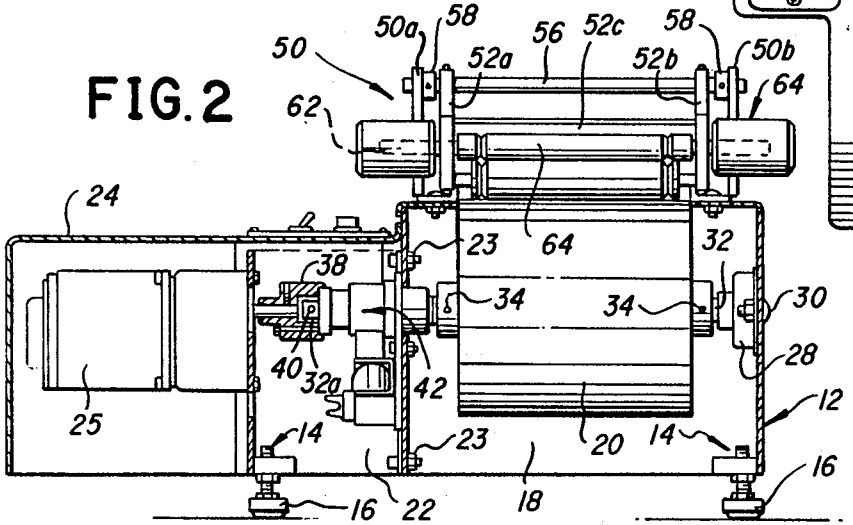
FIG. 2 is an end elevational view, partially in section, of the device of FIG. 1.
Figure 3:
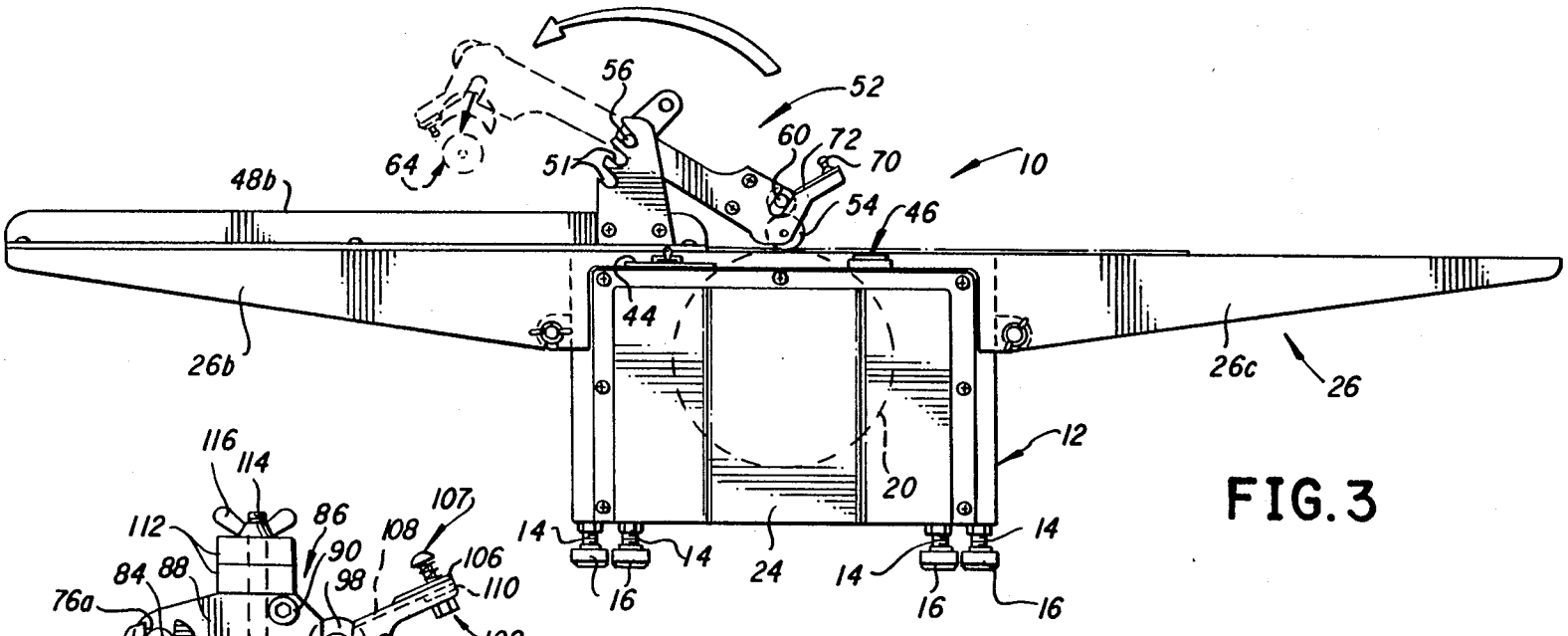
FIG. 3 is a side elevational view of the device of FIG. 1, illustrating, in dashed lines, the manner in which the applicator unit can be pivoted to an inoperative position or to permit removal thereof from the remainder of the device.

Referring to FIGS. 1 to 3, a preferred embodiment of the proofer device of the invention is shown. The proofer device, which is generally denoted 10, includes a base 12 supported by four adjustable, screw threaded support legs 14 having support pads 16 on which the device 10 rests. The base 12 includes a main housing 18 in which a rubber covered roll 20 is mounted, a motor support 22 secured to one side wall of housing 18 by suitable means including hex nuts 23, and a cover 24 which extends over motor support 22 and over a drive motor 25 which is mounted to motor support 22. A top plate 26 is mounted on and fits over main housing 18 and includes an opening or aperture 26a therein that exposes an upper portion of roll 20, as indicated in FIGS. 1 and 2.

Roll 20 is mounted within housing 18 by an arrangement including a flange mounted bearing 28 secured to a side wall of housing 18 by a pair of cap screws (only one of which, denoted 30 can be seen in FIG. 2), and a central shaft 32. A pair of spring pins 34 serve to secure shaft 32 to annular mounting supports 36 of roll 20. In an exemplary embodiment, roll 20 comprises a covering of natural rubber of 70–75 Durometer hardness bonded onto an aluminum roll. Shaft 32 includes an end portion **32*a* of reduced diameter which is coupled to the drive shaft 24*a* of drive motor 25 by a coupling member 38 and which is supported by a clutch-brake assembly 42. Clutch-brake assembly 42 is preferably of the wrap spring type (e.g., Warner No. CB-4-S-CW-3/8"-AC-115v) while motor 25** preferably comprises a speed control gearmotor (e.g., Oriental No. US425-201 $C_1$/4GK-15KA).

As is best seen in FIG. 1, a speed control unit 44 (e.g., as supplied by Oriental Motor as part of gearmotor 25) is mounted on cover 24 and is used to control the speed of motor 25. A push button start switch 46 (e.g., a Microswitch No. PWP23D-B28), also mounted on cover 24 and connected to a non-illustrated one-shot power supply (e.g. Warner No. 901-00-001), controls starting of motor 25. It will be appreciated that the motor control system for motor 25 is conventional and other or different motor controls can be used.

Top plate 26 is preferably formed by a pair of sections **26*b* and 26*c* which are joined together on opposing edges and which include aligned edge slots formed centrally therein that define the aforementioned aperture or opening 26*a* therebetween. Top plate 26 includes a pair of guide rails 48*a* and 48*b* for guiding a sheet of paper or other substrate, denoted S, therealong. These rails 48*a*, 48*b*** are optional and are not included in a presently preferred embodiment.

An applicator cradle 50 is formed by a pair of notched uprights **50*a* and 50*b* which are respectively secured to guide rails 48*a* and 48*b* or directly affixed to top plate 26 and which include a series of inclined notches 51 formed in the rear edge thereof. In a presently preferred embodiment described below, a single pair of optimumly located notches is used. An applicator unit (proofing head) 52, which is perhaps best seen in FIG. 3, carries a transfer or printing roller 54. Roller 54 rests on cylindrical roll 20 (or on the sheet of paper or other substrate S disposed between roller 54 and roll 20). An applicator support rod 56 is mounted in applicator unit 52 at the end of the applicator unit opposite roller 54 (referred to herein as the proximal end). A pair of collars 58 mounted on support rod 56 cooperate with the ends of rod 56 which are received in the notches 48 in the notched uprights 50*a*, 50*b* of cradle 50 to fix proximal end of applicator unit 52 in position so as to enable pivoting the distal thereof around the axis defined by support rod 56. This pivoting action is illustrated in FIG. 3 and permits the substrate to be positioned between the rolls 54 and 20. Neglecting rod 56 and roll 54, applicator unit 52 is of a generally H-shape configuration in plan and includes side members or walls 52*a*, 52*b* and a central brace 52*c* (FIG. 1**).

A pair of slots (only one of which, denoted 60, is seen in FIG. 3) are formed in the respective side member walls **52*a*, 52*b* of applicator unit 52 and are designed to removably receive the support rod or shaft 62 of an anilox roller 64. As best seen in FIG. 2, anilox roller or cylinder 64 engages and bears against transfer or applicator roll 54 to apply pressure thereon. Removable end weights 68 (one of which is not shown in FIG. 3) are disposed at the end of rod 62 to add to the weight of anilox roller 64 and thus to the pressure exerted on transfer roll 54. As mentioned above and as is indicated in FIG. 3, anilox roller 64 is removable and can readily be replaced by a different anilox cylinder adapted to deposit a different amount of ink. End weights 68** are also replaceable to adjust the amount of pressure exerted.

Referring to FIG. 3, doctor blade device 70 (which is not shown in FIGS. 1 and 2) is mounted on applicator unit 52 and includes a doctor blade 72 which distal edge is disposed closely adjacent to anilox cylinder 64 so as to remove excess ink therefrom.

The operation of the proofer device of the invention should be evident from the foregoing. Applicator unit 52 is pivoted away from contact with drive roll 20 so that a substrate S can be fed therebetween, and with a substrate S in place, motor 25, under the control of start switch unit 46 and speed control unit 44, is used to drive roll 20 through means of clutch-brake assembly 38 to advance the substrate S with the transfer roll 54 in contact therewith. A selected ink carrying anilox cylinder 64 is mounted on applicator unit 52 in engagement with transfer or printing roll 54, and the calibrated weights carried by support rod 62 ensure that roll 54 applies a substantially constant pressure to the substrate S, while motor 25 ensures that proofing takes place a constant (selectable) speed. As noted above, the round drive roll 20 enables the device of the invention to achieve or reproduce the same angles of printing encountered during commercial flexographic printing while faster proofing speeds are provided by virtue of the clutch-activated motor drive system. More generally, as was also discussed above, the proofer of the invention makes it possible to obtain repeatable proofs, something that is not usually possible with prior art portable proofers.

Figure 5:
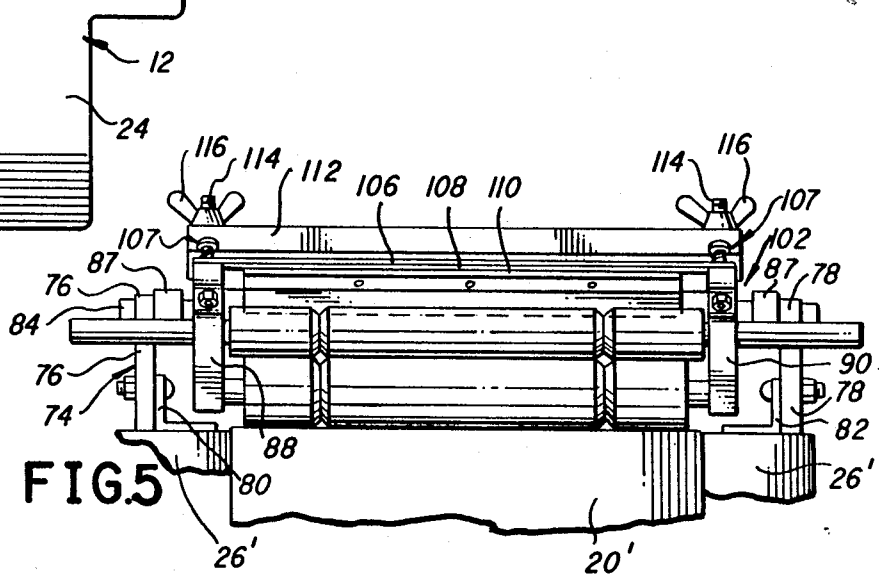
FIG. 5 is an end elevational view of the applicator unit of FIG. 4.
Figure 4:
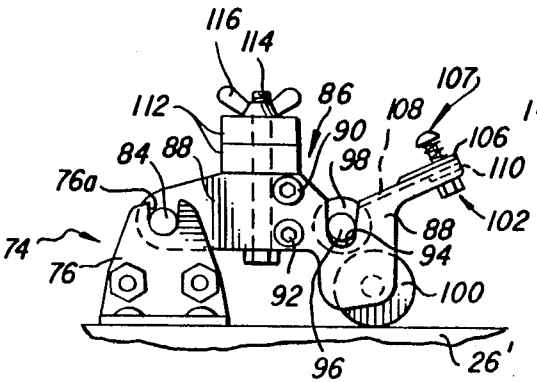
FIG. 4 is a side elevational view of an applicator unit (proofing head) in accordance with a further, presently preferred embodiment of the invention.

Referring to FIGS. 4 and 5, there is shown an applicator unit (proofing head) constructed in accordance with a presently preferred embodiment of the invention. The applicator unit of FIGS. 4 and 5 is positioned on the overall device in substantially the same location as described above for applicator unit 52 with reference to FIGS. 1 to 3, and like components of the overall device are given the same reference numerals with primes attached.

As illustrated in FIGS. 4 and 5, an applicator cradle 74 is formed by a pair of spaced mounting members or plates 76 and 78 affixed to and supported by brackets 80 and 82 secured to top plate 26'. Members 76 and 78 are shaped to define respective notches in the upper edges thereof, one of which, denoted 76a, is shown in FIG. 4. In the illustrated embodiment, brackets 80 and 82 are screwed or bolted to top plate 26' and mounting members 76 and 78 are screwed or bolted to respective brackets 80 and 82, as shown. The aligned notches in mounting members 76 and 78 support the ends of an applicator support rod 84. Rod 84 is mounted at one end of, and enables pivoting of, a roller support unit or applicator unit 86, while set screws and collars 87 (FIG. 5) fix unit 86 in place on rod 84. Roller support unit 86 comprises a pair of side walls 88 (shown in FIG. 4 only) and 90 (shown in FIGS. 4 and 5) connected together by, and spaced apart by, a pair of vertically aligned spacer bars, 92 and 94, the ends of which (see FIG. 4) are secured to side walls 88 and 90 of roller support unit 86 by cap screws, as shown in FIG. 4.

A pair of slots, one of which, denoted 94, is shown in FIG. 4, receive the free ends of a support rod 96 for an anilox cylinder or roller 98. A transfer roller 100 is mounted between side walls 88 and 90 in a manner similar to the transfer roller described above.

A doctor blade assembly 102 is mounted between forwardly extending portions of side walls 88 and 90 of unit 86 and although the doctor blade assembly can take a number of conventional forms, the assembly 102 preferably comprises a doctor blade support member 106 secured to side walls 88 and 90 by a pair of affixing means or assemblies 107 (each comprising a screw, a compression spring, and a nut as indicated in FIG. 4), and a doctor blade 108 captured between support 106 and a narrow doctor blade strap 110 located beneath the proximal end of blade 108, so that the distal end of blade 108 extends outwardly from support 106 and strap 110 to a position wherein this end of blade 108 removes excess ink from roller 98.

In the illustrated embodiment, a pair of calibrated weights, in the form of bars 112, are disposed so as to extend transversely of unit 86 between walls 88 and 90 and are secured to side walls 88 and 90 by screws 114 and wing nuts 116. It will be appreciated that bars of calibrated weights can be added or removed to provide the appropriate pressure.

The overall operation of the embodiment of FIGS. 4 and 5 is substantially the same as that described above for the embodiment of FIGS. 1 to 3.

Although the present invention has been described relative to exemplary embodiments thereof, it will be understood by those skilled in the art that other variations and modifications can be effected in these exemplary embodiments without departing from the scope and spirit of the invention.

We claim:

1. A portable, manually fed flexographic proofer device, said device comprising:

a cylindrical drive roll, a drive motor for said roll for providing rotation thereof at a constant speed;

an anilox cylinder;

a transfer roller for transferring ink from said anilox cylinder to a substrate disposed between the transfer roller and the drive roll;

an applicator unit carrying said anilox cylinder and transfer roller; and means for mounting said applicator unit on the proofer device so that said unit is movable between an inoperative position thereof and an operative position thereof in which the transfer roller exerts pressure on said drive roll; said applicator unit including means removably receiving a weight device thereon of a calibrated weight such that the pressure exerted by the transfer roller on the drive roll is substantially constant.

2. A proofer device as claimed in claim 1 wherein said applicator unit comprises means for removably mounting said anilox cylinder thereon

3. A proofer device as claimed in claim 1 further comprising a doctor blade mounted on said applicator unit.

4. A proofer device as claimed in claim 1 further comprising a base in which said drive roll is mounted, said applicator unit being mounted on said base.

5. A proofer device as claimed in claim 4, further comprising a top plate mounted on said base and having an aperture therein, and means for mounting said drive roll within said base such that a portion of the drive roll is exposed through said aperture so as to permit said transfer roller to exert pressure on said drive roll.

6. A proofer device as claimed in claim 3 wherein said drive roll comprises a cylindrical metallic roll having a elastomer covering o the cylindrical surface thereof.

7. A flexographic proofer device as claimed in claim 1 further comprising a clutch-brake unit disposed between said drive roll and said drive motor.

8. A flexographic proofer device as claimed in claim 1 wherein said mounting means includes a mounting cradle and said applicator unit is pivotably mounted on said mounting cradle.

9. A flexographic proofer device as claimed in claim 8 wherein said mounting cradle comprises a pair of uprights having aligned notches formed in the edges thereof and said applicator unit includes a mounting rod which is selectively and removably mountable between the aligned notches of the pair of uprights.

10. A flexographic proofer device as claimed in claim 1 wherein said applicator unit includes a pair of spaced side walls having aligned slots therein in which said anilox cylinder is removably received.

11. A flexographic proofer device as claimed in claim 8 wherein said weight device comprises at least one calibrated bar extending transversely on and removably mounted on said applicator unit.

12. A flexographic proofer device as claimed in claim 1 further comprises speed control means for enabling selection of said constant speed.

13. A flexographic proofer device as claimed in claim 1 wherein said top plate comprises a pair of plates each having a slotted edge including a central slot therein, and wherein said plates are mounted on said base with the slotted edges thereof in abutment such that the central slots therein are aligned to form said aperture.

14. A portable manually operated flexographic proofer device, said device comprising;

a base;

a top plate, mounted on said base, and on which a printing substrate is received which has an aperture therein;

a cylindrical drive roll, having an elastomer covering on the cylindrical surface thereof, mounted within said base so that a portion of the cylindrical surface thereof is exposed through said aperture in said top plate;

a drive motor for said roll for providing rotation thereof at a constant speed;

a transfer roller;

an applicator unit carrying said transfer roller and mounted on said base such that, in the operative position thereof, the transfer roller exerts pressure on the portion of said drive roll exposed through said aperture in said top plate;

an anilox cylinder removably mounted on said applicator unit in engagement with said transfer roller; and calibrated weight means removably mounted on said applicator unit for increasing the pressure exerted by the transfer roller on the drive roll such that a substantially constant pressure is applied to said drive roll.

15. A flexographic proofer device as claimed in claim 14 further comprising a clutch-brake unit disposed between said drive roll and said drive motor.

16. A flexographic proofer device as claimed in claim 14 wherein said mounting means includes a mounting cradle and said applicator unit is pivotably mounted on said mounting cradle.

17. A flexographic proofer device as claimed in claim 16 wherein said mounting cradle comprises a pair of uprights having aligned notches formed in the edges thereof and said applicator unit includes a mounting rod which is selectively and removably mountable between the aligned notches of the pair of uprights.

18. A flexographic proofer device as claimed in claim 14 wherein said applicator unit includes a pair of spaced side walls having aligned slots therein in which said anilox cylinder is removably received.

19. A flexographic proofer device as claimed in claim 14 further comprises speed control means for enabling selection of said constant speed.

20. A flexographic proofer device as claimed in claim 14 further comprising a doctor blade mounted on said applicator unit for removing excess ink from said anilox cylinder.

* * * * *